US006105815A

United States Patent [19]

Mazda

[11] Patent Number: 6,105,815

[45] Date of Patent: Aug. 22, 2000

[54] CONTRACTION-CONTROLLED BELLOWS CONTAINER

[76] Inventor: Masayosi Mazda, 3-70 Ohno-Cho, Kakamihara, Gifu 504, Japan

[21] Appl. No.: 08/993,365

[22] Filed: Dec. 18, 1997

Related U.S. Application Data

[63] Continuation-in-part of application No. 08/763,880, Dec. 11, 1996, abandoned.

[51] Int. Cl.[7] ..... B65D 81/32

[52] U.S. Cl. ..... 220/666; 215/382

[58] Field of Search ..... 220/666; 215/381, 215/382, 383, 384, 900

[56] References Cited

U.S. PATENT DOCUMENTS

| | | | |
|---|---|---|---|
| 3,270,905 | 9/1966 | Kroekel | 220/666 X |
| 3,301,293 | 1/1967 | Santelli | 220/666 |
| 4,773,458 | 9/1988 | Touzani | 220/666 |
| 4,887,730 | 12/1989 | Touzani | 220/666 X |
| 4,955,493 | 9/1990 | Touzani | 220/666 X |
| 5,002,193 | 3/1991 | Touzani | 220/666 X |
| 5,310,068 | 5/1994 | Saghri | 220/666 X |
| 5,573,129 | 11/1996 | Hagata et al. | 215/382 |
| 5,584,413 | 12/1996 | Jung | 220/666 |
| 5,615,791 | 4/1997 | Vatelot et al. | 215/382 |

FOREIGN PATENT DOCUMENTS

| | | |
|---|---|---|
| 55-156032 | 11/1980 | Japan . |
| 64-58660 | 3/1989 | Japan . |
| 2-19253 | 1/1990 | Japan . |

*Primary Examiner*—Steven Pollard
*Attorney, Agent, or Firm*—Cantor Colburn LLP

[57] ABSTRACT

A contraction-controlled bellows container (1) is disclosed, which can retain half or fully contracted configurations of the bellows ridges (2) whose upper walls (21) and/or lower walls (22) have at least one circumferential indentation (3) adjacent the corresponding outer hinges (23) and/or inner hinges (24). The indentations utilize the pressure applied onto the container effectively and get depressed further into the corresponding bellows ridges prior to the corresponding portions of the other walls, reducing the total pressure requirement. The indentations bring together the walls in which the indentations are provided into the bellows ridges (2). These walls are gradually turned in shape to lose their shape restoration thanks to their generally protruding configuration. Adjustment of the sizes of the indentations makes it possible to selectively contract the bellows ridges.

15 Claims, 7 Drawing Sheets

CONTRACTION-CONTROLLED BELLOWS CONTAINER

CROSS REFERENCE TO RELATED APPLICATIONS

This application is a continuation-in-part of U.S. patent application Ser. No. 08/763,880 filed Dec. 11, 1996.

TECHNICAL FIELD

This invention generally relates to a contractible bellows container. More particularly, this invention relates to a contraction-controlled bellows container.

BACKGROUND ART

A conventional contractible bellows container chiefly comprises a generally tubular bottle like container portion and bellows which protrude at a right angle from the container portion. A conventional contractible bellows container is generally used to contain and press out a viscous material. Each conventional bellows ridge is formed as a ring body, provided around the container body portion, consisting of two plane rings of the same size. The two plane rings meet at their outer rims with an angle and provide a circular outer hinge (hereinafter referred to as "outer hinge"). The inner circular hinges (hereinafter referred to as "inner hinges") of the plane rings are apart. When the container is pressed generally in the direction of its longitudinal axis to press out its content, both the plane rings of the bellows are pressed toward each other hinging on the respective outer hinges, and the bellows are eventually closed.

The pressure applied to such a conventional bellows container containing a fluid receives repulsive forces from the fluid and bellows {from the upper plane rings (hereinafter referred to as "upper walls") and the lower plane rings (hereinafter referred to as "lower walls")}. The repulsive forces from the bellows should be eliminated as much as possible. Technically, bellows walls (upper and lower walls) can be made very thin to reduce such repulsive forces, however, it is often disadvantageous to make the bellows walls too flexible. A bellows container needs to be rigid enough to hold its content stably and must be tough enough to bear the pressure applied to it. Otherwise, the container cannot be bellowed.

It has not been practical to provide a hard plastic bottle with a truly workable bellows feature. A hard plastic bottle like a PET (polyethylene terephthalate) bottle may be provided with conventional bellows, but it would not be contracted easily because of the considerable repulsive forces from all its bellows.

Another drawback with a conventional bellows container is that its bellows once contracted fully or halfway return to their original configuration when the pressure to the container is removed, and the bellows open again. Air is sucked into the container, which often damages its contents.

Emptied containers whose original configurations are restored are also a serious volume problem to recycling and disposal as well as to the environment.

There have been proposed a number of plastic bellows containers in an attempt to eliminate or ease such drawbacks. The following three proposed bellows containers are considered by the present inventor "best" among them.

Japanese Utility Model Laid-Open Publication No. 55-156032 discloses a contractible plastic bellows container having bellows each ridge formed of a plane upper wall and a plane lower wall. The upper wall and lower wall of each bellows ridge are differently angled or sized in an attempt to reduce the repulsive force from the ridge. However, the problem of the repulsion is not corrected completely due to the "plane" wall configuration of the bellows. The problem of shape restoration of the bellows is not addressed, either. Further, those bellows cannot be fully closed as the upper walls and lower walls are differently sized, causing unintended distortion in the bellows walls, as a person skilled in the art will realize.

Japanese Patent Publication No. 2-19253 discloses a contractible plastic bellows container having "open rings" provided at the inner hinges of the bellows in an attempt to ease the contraction of the bellows and prevent degradation of the material at these hinges in repeated uses. Those open rings are provided astride the upper walls and lower walls equally. As a person skilled in the art knows, those open rings are naturally made "thick" by blow molding which is the conventional and most widely utilized plastic container manufacturing method. These thick rings do not ease contraction of the bellows very well. The problem of restoration of shape is not dealt with in this bellows container, either. Those bellows will not fully close as their upper walls and lower walls are differently sized, causing unintended distortion in the bellows walls.

Japanese Patent Publication No. 64-58660 discloses a inflatable plastic bellows container which utilizes a number of hemispheric (in vertical section) bellows unlike the foregoing two bellows containers which utilize plane bellows walls. The bellows ridges of this container are originally contracted and layered to be pulled upward in use to open.

Even if such a container is to be used conventionally (to be contracted from its "open"configuration), vertical pressure applied to the container would meet with considerable repulsion from the bellows whose upper walls and lower walls are formed substantially identically. The pressure applied would be consumed equally on the upper walls and lower walls. The dispersed pressure energy would be consumed not only to close the bellows but to expand the bellows sideways creating no value, and unfavorably deform the bellows walls. The applied pressure power would not be effectively utilized in contraction of the bellows.

Those bellows are provided with a small protruding or depressed circumferential wedge at each outer hinge to smooth the opening of the bellows. Such wedges would eliminate the aforementioned unfavorable deformation of the bellows walls to an extent. However, these protrusions or concavities are equally provided astride the upper walls and lower walls of the bellows, and no distinction of function between these walls is intended. Bellows having such a hemispheric configuration would intrinsically warp to one side when contracted. (This is one of the features intended in the present invention.) The direction of warping is not controlled, and therefore the randomly (upwardly or downwardly) warping bellows would likely hinder the layering of the bellows ridges.

As will be understood by a person skilled in the art, the aforementioned problem of restoration of shape is intrinsically coped with to a degree by that hemispheric bellows shape. However, because the inner hinges (upper and lower) of each bellows ridge are vertically wide apart when the ridge is open, it would take a considerable "time" for each bellows ridge to show the termination of the restoration of shape when used conventionally. The bellows would retain a restorative function during most of use.

That container additionally utilizes open rings provided at the inner hinges (not on the upper walls or inner walls of the bellows) to ease the opening of the bellows. However, the open rings are intrinsically made thick and would not function as desired. Rather, these open rings would prevent full contraction of the bellows ridges.

Accordingly, it is an object of the present invention to provide a contractible bellows container whose bellows repulsion is substantially reduced. It is another object of the present invention to control the order of contraction of bellows ridges to further reduce the repulsion. It is still another object of the present invention to provide early termination of restoration of shape of bellows and substantially retain the fully or half contracted configuration of the bellows in use. It is an additional object of the present invention to provide truly workable bellows to a hard plastic container such as a PET bottle. Other objects of the present invention intrinsically belong to the bellows containers made according to the present invention.

SUMMARY OF THE INVENTION

Generally, plastic containers including contractible plastic bellows containers are manufactured by blow molding, which is suitable for mass production of plastic containers. The farther the container wall portion of a plastic bellows container is from the longitudinal axis of the container, the thinner the container wall portion becomes. The outer hinge portions are made the thinnest and the inner hinge portions are made the thickest (excluding the top and bottom portions of the container). It is impractical not to take such an intrinsic feature of blow molding into consideration in designing a plastic bellows container. As a person skilled in the art knows, there also exist a number of restrictions intrinsic to blow molding. It is also impractical not to take these intrinsic restrictions into consideration. Bellows containers according to the present invention are designed so that they can be advantageously manufactured by blow molding, however, contractible bellows containers according to the present invention may be manufactured by other molding methods presently known in the art. Plastic materials for manufacturing the containers of the present invention may be freely selected from those known in the art as well.

Hereinafter, the present invention is described supposing containers are placed at a standing position, i.e., their longitudinal axes are vertical. The bellows of the present invention are generally and basically convex, their upper walls and lower walls being roundly protruded in their overall configurations. When such a convex bellows ridge is pressed vertically at its inner hinges, eventually only one of its walls is pressed into the ridge. The bellows ridge gradually loses restoration of shape when a wall is gradually turned from its convex configuration to concave configuration, eventually to a substantially symmetrical configuration. Once that wall assumes the shape of concavity, the wall is next provided with a motion or energy working toward the other wall and it finally contacts the other wall. The contracted bellows ridge warps toward that concave wall.

It is an intention of the present invention to control at will the depression properties of the bellows of containers and the direction of the warping of the bellows ridges.

Besides that "basic" convex configuration, the bellows ridges of the present invention can assume other configurations and still enjoy the features intended by the present invention, which will be explained later in detail. For example, the wall of a bellows ridge may be substantially "plane."

Bellows containers of the present invention can have various configurations in horizontal section, not only a circular configuration but also oval or square configurations to name a few. Accordingly, the term "circular configuration" as used hereinafter should be construed as including an oval configuration and other configurations which are continuous circumferential firing"configurations.

The bellows of a bellows container according to the present invention at least selectively have a circular or circumferential indentation or indentations in their upper walls and/or lower walls. A circular indentation is provided generally adjacent the outer hinge or one of the inner hinges of a bellows ridge. Hereinafter the term "circular indentation" or "circumferential indentation" is generally referred to as "indentation" for the convenience of description. One bellows ridge may have two or more of such indentations in its lower wall or upper wall, or each wall may have one indentation or more.

The intended features of indentations and their functions will be described hereinafter in detail. When the term pressure is used hereinafter to describe the features and functions of the indentations of a bellows container, it should be construed as also meaning "suction" from an opening of the container since the bellows containers of the present invention will function substantially similarly in both cases.

Vertical pressure applied to a bellows ridge having an indentation or indentations is effectively and preferentially absorbed and utilized by the indentation or indentations, and contraction of the ridge takes place effectively and less strenuously as the wall or walls including the indentation or indentations are depressed inwardly together with the inwardly "moving" indentation or indentations. It is possible to select which wall to be depressed by selectively providing an indentation or indentations to bellows walls. Because the wall having such an indentation or indentations is generally convex in its overall configuration, the wall entering the bellows ridge eventually and substantially gets turned or reversed in shape, losing its shape restoration momentum, and gains a momentum to approach the other wall. The contracting bellows ridge will warp toward the depressed wall.

If such indentations are provided in an arrangement, e.g. only on the upper walls of bellows, then the warping of the bellows ridges can be arranged in one direction, and these bellows ridges will be neatly layered. There will be no conflict between warping bellows ridges.

The function of an indentation is subject to the overall design of the indentation, including its "size" which may be conveniently represented by the vertical sectional depression area. However, that function is also subject to the shape of the indentation including the depth and length as well as local angles of the indentation. Generally, a large size indentation will provide a better utilization of pressure energy than a small size indentation. Here, "better utilization" means that a bellows ridge having a large indentation can be further depressed preferentially to and more easily than another bellows ridge having a small indentation. The order of contraction of bellows ridges can thus be controlled by providing the bellows ridges with different size indentations, respectively, which substantially reduces the pressing energy required since the pressing energy can be substantially concentrated on one bellows ridge, or utilized ridge by ridge.

It is now possible to provide even a hard plastic container such as a PET bottle with a truly workable bellows function utilizing above described indentations, more advantageously utilizing size controlled indentations.

The present invention will be described in more detail hereunder using the accompanying drawings.

BRIEF DESCRIPTION OF THE DRAWINGS

FIG. 1(*a*) to FIG. 1(*c*) show the contraction process of the ridge portion.

FIG. 2(*a*) to FIG. 2(*c*) show the contraction process of the ridge portion.

FIG. 8(*a*) to FIG. 8(*c*) show the contraction process of the ridge portion.

DETAILED DESCRIPTION OF THE PREFERRED EMBODIMENTS

Figure 1:
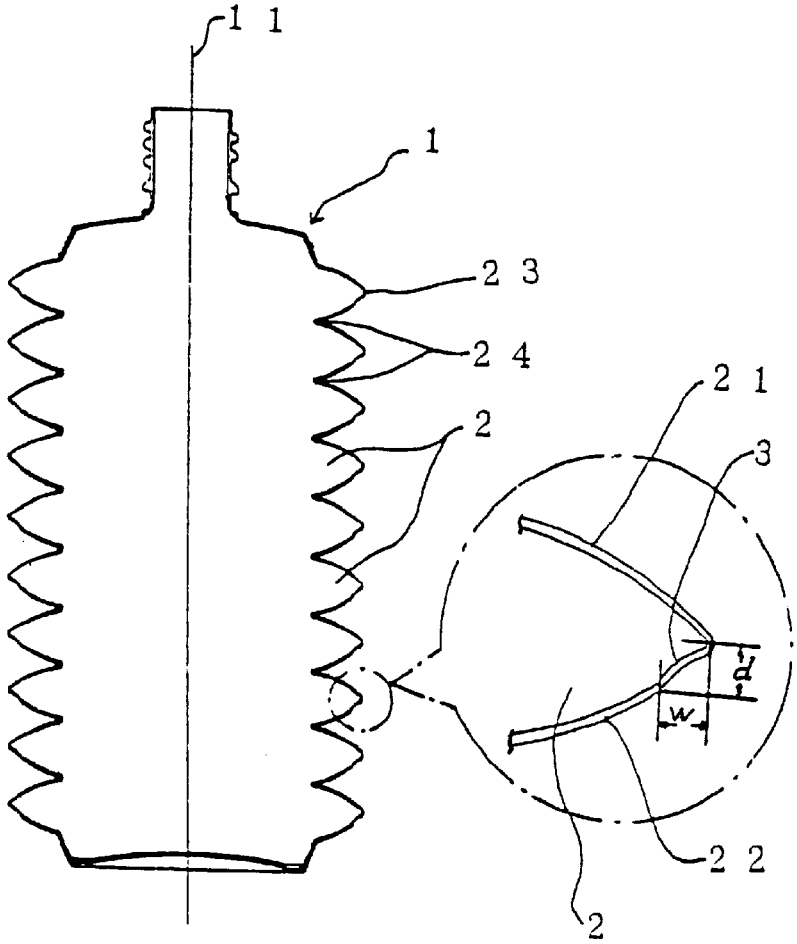
FIG. 1 is a vertical sectional view of a bellows container having bellows according to an embodiment of the present invention, taken along its longitudinal axis, and a partially enlarged view showing a bellows ridge portion in vertical section.
Figure 1A:
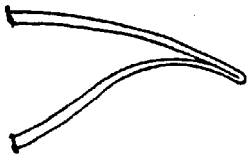
Figure 1B:
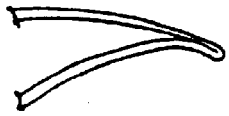
Figure 1C:
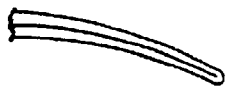

FIG. 1 shows a bellows container 1 according to an embodiment of the present invention, each bellows ridge portion 2 (hereinafter generally referred to as "bellows ridge" or "just it ridge" for the convenience of description) having a convex upper wall 21 and a substantially convex lower wall 22. The degrees of the convexities will be determined depending upon factors such as use, material, size, etc., of the container 1. Here and with all the other embodiments to be described hereunder, pressure (suction) is vertically applied substantially on the longitudinal axis 11.

Each bellows ridge 2 in this embodiment is provided with a circular indentation 3 on its lower wall 22 adjacent the outer hinge 23. The highest portion of the indentation 3 will not generally go above the imaginative horizontal plane including the outer hinge 23. The overall configuration of the indentation 3 including vertical depth (d) and horizontal width (w) will be designed subject to the shape, size, material, etc., of the bellows ridge 2 as well as the contractional feature desired of the bellows ridge 2.

Generally, the wider (w) and the deeper (d) an indentation, the more easily a bellows wall having the indentation will be depressed into the bellows ridge.

The local angles of an indentation will affect the work of the indentation as well. In short, the feature of an indentation will greatly depend upon the overall design of the indentation.

Such an indentation may be configured with a combination of (a) curves, (b) curves and lines, or (c) a combination of lines. Throughout the embodiments, only representative configurations are provided for the purpose of describing the present invention.

As a person skilled in the art will know, such an indentation in a bellows wall of a bellows ridge will be made thinner by blow molding than the corresponding portion of the other wall of the bellows ridge, since the length of a stretched indentation is larger than the corresponding portion of the other wall. Therefore, such an indentation is always considerably more flexible than that corresponding portion, which will advantageously assist the work of an indentation.

When the bellows container 1 is pressed vertically, the pressure first acts upon the inner hinges 24 of the bellows ridges 2 in opposite directions, respectively. Then the pressures working on the inner hinges 24 are partially converted into the "rotary moments" to work on the upper walls 21 and lower walls 22 of the bellows ridges 2, the outer hinges 23 working as circular rotary fulcrums, respectively.

The indentations 3 provided in the lower walls 22 absorb and utilize the rotary moments prior to the corresponding portions of the upper walls 21 and are depressed further into the bellows ridges 2, bringing together the other portions of the lower walls 22. The upper walls 21 will substantially retain their original convex configuration (which provides considerable resistance against deformation, as will be understood by a person skilled in the art) and will assist further depression of the indentations 3 without utilizing the rotary moments acting upon the upper walls 21 for themselves. Thus, the pressure applied on the container 1 is effectively absorbed and utilized at the indentations 3 and the bellows ridges 2 are easily deformed from the lower walls 22, as shown in FIG. 1(*a*). Simply said, bellows ridges 2 having such indentations 3 will start closing with less pressure on the container 1 than bellows ridges having no such indentations.

When the pressure is continuously applied on the container 1, the lower walls 22 start to eventually and substantially be reversed in shape as shown in FIG. 1(*b*). The lower walls 22 are given upward momentums and will no longer go back to their original convex shape. When the contents (not shown) in the bellows ridges 2 are all pressed out, the lower walls 22 contact the corresponding upper walls 21. The bellows ridges 2 are warped toward the lower walls 22 as shown in FIG. 1(*c*), and layered neatly.

It is advantageous that the length of the upper walls 21 and that of the lower walls 22 having the indentations 3 (when stretched) are substantially the same to avoid generation of strain in the walls 21 and 22. Such is attainable by appropriately designing the bellows ridges 2. This would advantageously apply to all the other embodiments of the present invention.

Figure 2:
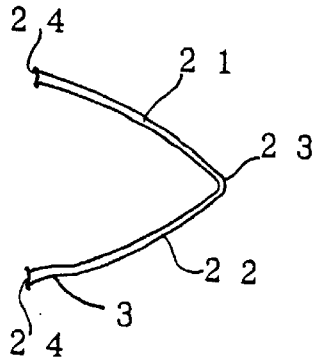
FIG. 2 is a vertical sectional view of a bellows ridge portion according to another embodiment of the present invention.
Figure 2A:
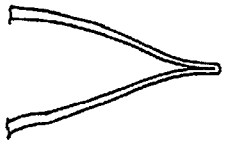
Figure 2B:
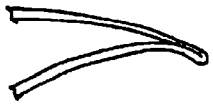
Figure 2C:
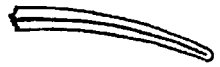

FIG. 2 shows a bellows ridge 2 according to another embodiment of the present invention. Generally, a plurality of such bellows ridges 2 are to be incorporated in a bellows container. This applies to the other embodiments showing only a single bellows ridge. This bellows ridge 2 has an indentation 3 in the lower wall 22 adjacent its inner hinge 24. When a pressure is applied on the container (not shown) vertically, the inner hinges 24 of the bellows ridge 2 receive the pressure (the upper wall 21 receiving a downward pressure and the lower wall 22 receiving an upward pressure). The downward pressure on the upper inner hinge 24 is converted into a rotary moment working on the upper wall 21, and the upward pressure on the lower inner hinge 24 is converted into a rotary moment working on the lower wall 22, both hinging on the outer hinge 23. These rotary moments are first partially consumed to deform the outermost portions of the bellow ridge 2 substantially equally, as shown in FIG. 2(*a*). Then the rotary moment of the lower wall 22 is partially utilized at the indentation 3 prior to the corresponding portion of the upper wall 21, and the lower wall 22 starts entering the bellows ridge 2 as shown in FIG. 2(*b*). FIG. 2(*c*) shows the state of the bellows ridge 2 which is fully contracted.

Figure 3:
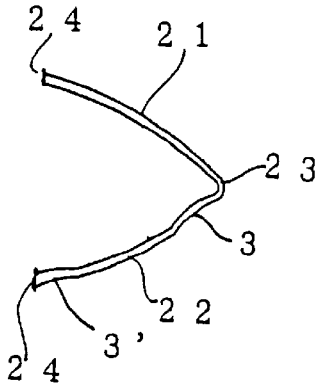
FIG. 3 is a vertical sectional view of a bellows ridge portion according to another embodiment of the present invention.

FIG. 3 shows a bellows ridge 2 according to another embodiment of the present invention, having two indentations 3 and 3' in the lower wall 22, one 3 adjacent the outer hinge 23, and the other 3' adjacent its inner hinge 24. Both the indentations 3 and 3' will respectively function as explained earlier. The lower wall 22 will be depressed prior to the upper wall 21 more easily than a case of only a single indentation due to the dual function of two indentations.

The indentations 3 (and 3') described in the foregoing three embodiments may be provided on their respective upper walls 21 instead (not shown here), in which cases the functions of the indentations 3 take place on the upper walls 21, and the bellows ridges 2 will warp upwards when closed.

Figure 4:
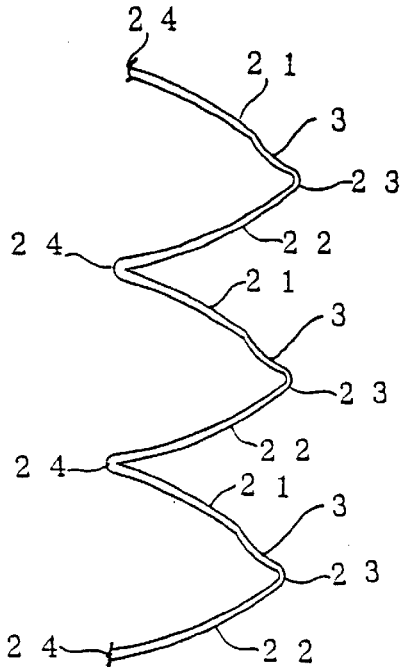
FIG. 4 is a vertical sectional view, showing an arrangement of bellows portions according to an embodiment of the present invention.
Figure 5:
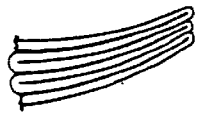
FIG. 5 is a vertical sectional view, showing a fully contracted state of the bellows portions of FIG. 4.

FIG. 4 shows an arrangement of bellows ridges 2 according to an embodiment of the present invention. Indentations 3 here are provided on the upper walls 21 adjacent their outer hinges 23. The upper walls 21 will be depressed toward the lower walls 22 respectively. The contracted bellows 2 will warp upwards and will be layered neatly as shown in FIG. 5.

Figure 6:
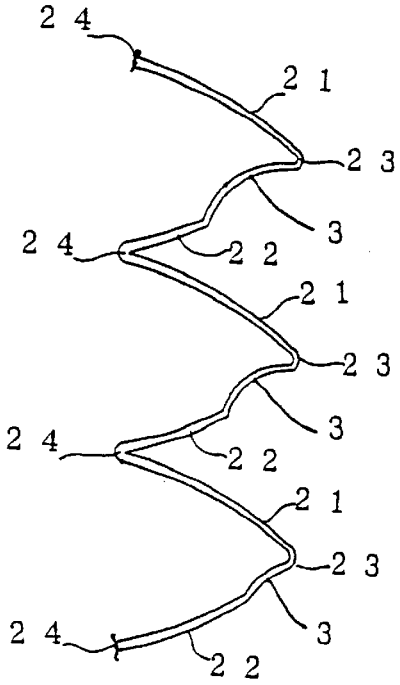
FIG. 6 is a vertical sectional view, showing another arrangement of bellows portions according to another embodiment of the present invention.

FIG. 6 shows another arrangement of bellows ridges 2 according to another embodiment of the present invention, which will be utilized to greater advantage in a hard plastic container such as a PET bottle (not shown). The "sizes" of indentations 3 respectively provided in the lower walls 22 of the bellows 2 adjacent their outer hinges 23 are different. The uppermost indentation 3 is the largest in size and the lowermost indentation 3 is the smallest in size.

The term "size" here is defined as described earlier as meaning that a larger size will provide the aforementioned function of an indentation better than a smaller size.

The indentation 3 and lower wall 22 of the uppermost bellows ridge 2 will be first depressed by utilizing the applied pressure prior to the others, and the indentation 3 and lower wall 22 of the lowermost bellows ridge 2 will be depressed last. All bellows ridges 2 will warp downwards and will be layered neatly (not shown). Thus, it is possible to selectively control the order of depression timing of bellows ridges by adjusting the "size" of each indentation. When provided with this type of indentation arrangement, a hard plastic bottle having such bellows will only require substantially less pressure to contract as the pressure energy is utilized substantially ridge by ridge.

Figure 7:
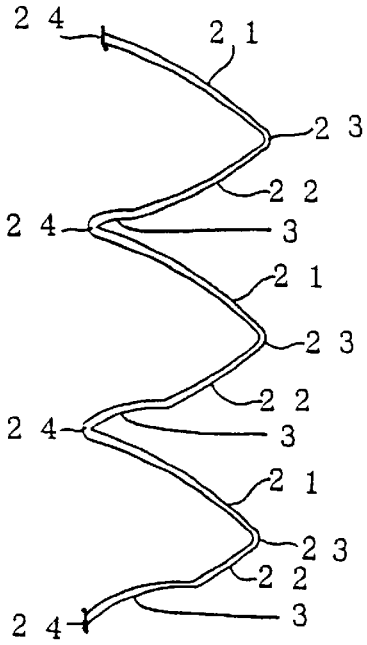
FIG. 7 is a vertical sectional view, showing still another arrangement of bellows portions according to still another embodiment of the present invention.

FIG. 7 shows another arrangement of bellows ridges 2 according to another embodiment of the present invention, having indentations 3 on their lower walls 22 adjacent the respective inner hinges 24. Here the lowermost indentation 3 has the largest size and the uppermost indentation has the smallest size. The lower wall 22 of the lowermost bellows ridge 2 will be depressed first and the lower wall 22 of the uppermost bellows ridge 2 will be depressed last. All bellows ridges 2 will warp downwards and will be layered neatly (not shown).

The indentations 3 of different sizes of the two embodiments above may be respectively provided on the upper walls 21 instead (not shown), in which cases, the functions of the indentations 3 will take place on the upper walls 21, and the bellows ridges 2 will warp upward to be layered neatly.

A hard plastic bellows bottle having such size controlled indentations on its bellows will be very easily depressed. When a carbonated drink is contained in such a bottle, the freshness of the drink can be kept a long time since the bottle can be depressed ridge by ridge as the content decreases, and each contracted bellows ridge will be held contracted. As will be understood by a person skilled in the art, the loss of shape restoration of a single bellows ridge will take place quickly. Therefore, only little air will be sucked into the bottle.

Figure 8:
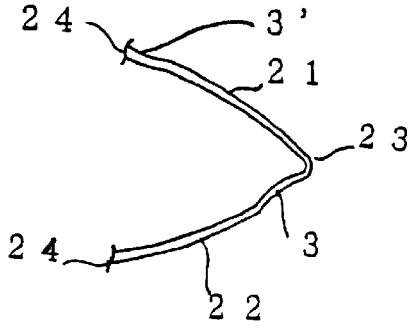
FIG. 8 is a vertical sectional view of a bellows ridge portion according to an applied embodiment of the present invention.
Figure 8A:
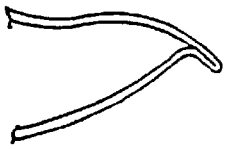
Figure 8B:
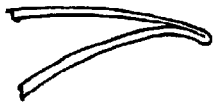
Figure 8C:
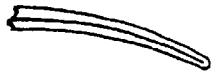

FIG. 8 shows a bellows ridge 2 according to an applied embodiment of the present invention. In this embodiment, the upper wall 21 has an indentation 3' adjacent its inner hinge 24, and the lower wall 22 has an indentation 3 adjacent the outer hinge 23. As shown from FIG. 8(*a*) to FIG. 8(*c*), the bellows ridge 2 will generally be depressed from the lower wall 22 since the indentation 3 provided nearer the outer hinge 23 will utilize the afore described rotary moment prior to the corresponding portion of the upper wall 21 as well as prior to the indentation 3' provided adjacent the inner hinge 24.

The indentation 3' in this case will work to assist and promote the whole depression of the bellows ridge 2. However, if the "size" of the indentation 3' is substantially larger than the indentation 3, then the upper wall 21 may be depressed instead of the lower wall 22 (not shown).

Figure 9:
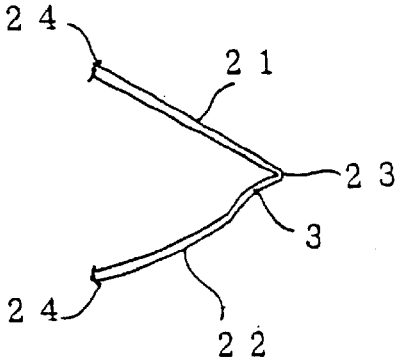
FIG. 9 is a vertical sectional view of a bellows ridge portion according to a special embodiment of the present invention.

FIG. 9 shows a bellows ridge 2 according to a special embodiment of the present invention. In this embodiment, a sufficient indentation 3 is provided in the lower wall 22 adjacent the outer hinge 23. The upper wall 21 is substantially plane. As will be understood by a person skilled in the art, the upper wall 21 is made thicker conventionally than when it is convex or concave, thus the upper wall 21 is considerably more rigid than the lower wall 22.

The lower wall 22 will be depressed into the bellows ridge 2 additionally assisted by the indentation 3. The upper wall 21 will eventually and slightly warp downwards. The ridge configuration may be provided upside down, in which case the upper wall 21 will enter the bellows ridge 2 (not shown).

The lower wall 22 can be substantially plane as well except the portion of the indentation 3 (not shown), in which case, the lower wall 22 will still be depressed into the ridge 2 due to the function of the indentation 3. The lower wall 22 will assume a shape of concavity, and lose its shape restoration just like the embodiment shown in FIG. 9. Eventually, the upper wall 21 will warp downwards slightly.

Figure 10:
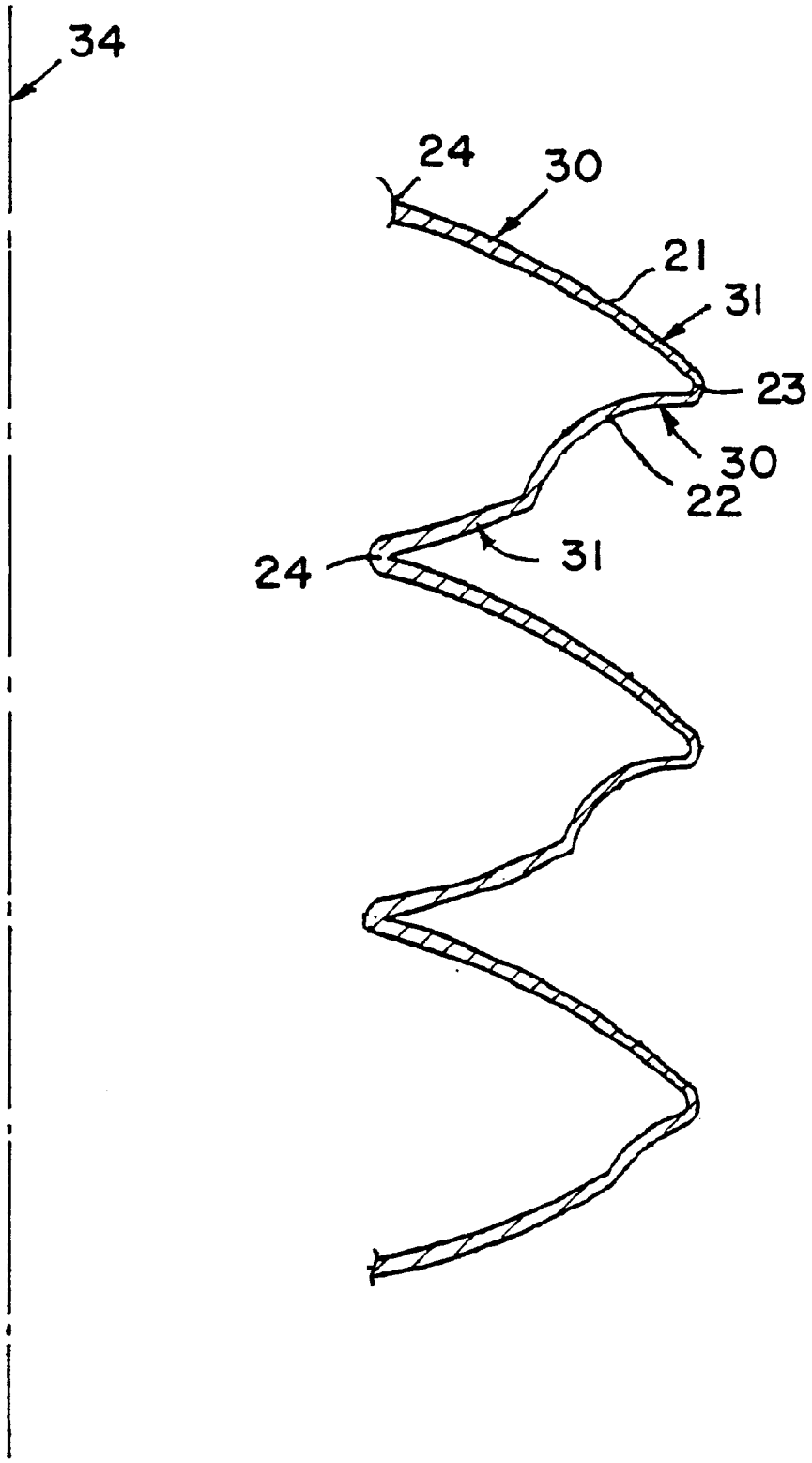
FIG. 10 is a vertical section view of a bellows ridge portion according to another embodiment of the invention.

FIG. 10 is a vertical section view of a bellows ridge portion according to another embodiment of the invention. The bellows ridges include an upper bellows wall 21 and a lower bellows wall 22 joined at an outer hinge 23. The upper bellows wall 21 is joined to an adjacent bellows wall at inner hinge 24. The lower bellows wall 22 is joined to another adjacent bellows wall at inner hinge 24. The upper bellows wall 21 is generally s-shaped and includes a concave deformation 30 positioned adjacent the inner hinge 24 and a convex portion 31 adjacent the outer hinge 23. The convex portion 31 is adjacent to and integral with the concave deformation 30. The lower bellows wall 22 is also generally s-shaped and includes a concave deformation 30 positioned adjacent the outer hinge 23 and a convex portion 31 adjacent the inner hinge 24. The convex portion 31 is adjacent to and integral with the concave deformation 30. The concave deformations 30 are smooth and round and lack any sharp edges or angled surfaces that may prevent smooth and complete contraction of the bellows ridge. The concave deformations 30 have a length that is approximately ⅕ to ½ of the entire length of the bellows wall.

FIG. 10 also illustrates another feature of the invention. The thickness of the bellows walls varies as the distance from the container centerline 34 varies. Closer to the centerline, the upper bellows wall 21 is thick. As the upper bellows wall 21 proceeds towards outer hinge 23 and away from centerline 34, the wall thickness decreases. Lower bellows wall 22 has a similar varying thickness. This feature facilitates contraction of the bellows ridges.

The use of concave deformations 30 assists in bringing the bellows walls into a contracted state and is particularly useful with hard plastic containers such as PET bottles. Prior art bellows containers do not function satisfactorily when the bottle is made from a hard plastic such as PET. In the present invention, even hard plastic bottles can be easily contracted and not return to their original un-contracted state. As pressure is applied to the contractible container, the bellows ridges contract in a sequential fashion so that one bellows ridge contracts only after a previous bellows ridge has contracted. In this way, each bellows ridge contracts in the same direction and in an orderly fashion.

Figure 11:
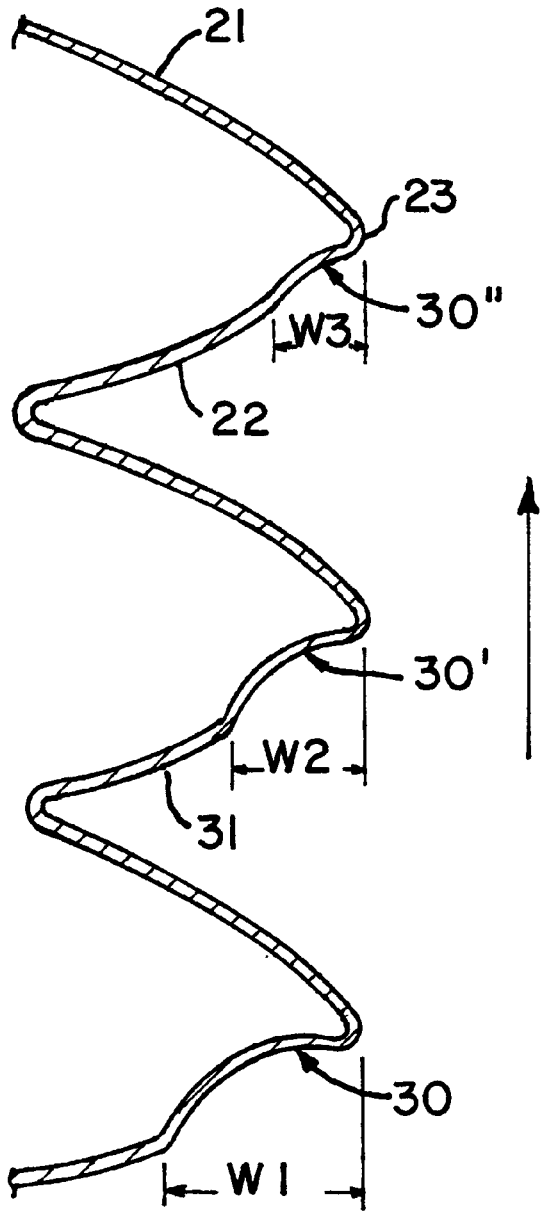
FIG. 11 is a vertical section view of a bellows ridge portion according to another embodiment of the invention.

FIG. 11 is a vertical section view of a bellows ridge portion according to another embodiment of the invention. The upper bellows wall 21 is generally convex. The lower bellows wall 22 is generally s-shaped and has a concave deformation 30 adjacent to the outer hinge 23 and a convex portion 31 integral with and adjacent to the concave deformation. The bellows walls may have varying thickness as described above with reference to FIG. 10. As shown in FIG. 11, the lowest bellows ridge has a concave deformation 30 having a width W1. The adjacent bellows ridge has a concave deformation 30' having a width W2 , where W2 is smaller than W1. The next bellows ridge has a concave deformation 30" having a width W3, where W3 is smaller than W2. By varying the width of the concave deformation 30, the contraction of the bellows ridges can be controlled to occur in an orderly, sequential fashion. As shown by the arrow in FIG. 11, the lowest bellows ridge having concave deformation 30 will collapse first, followed by the next bellows ridge having concave deformation 30' followed by the next bellows ridge having concave deformation 30". The wider the concave deformation, the easier it is for the bellows ridges to collapse. Accordingly, by varying the width of concave deformation 30, contraction of the bellows ridges can proceed in a sequential fashion.

Figure 12:
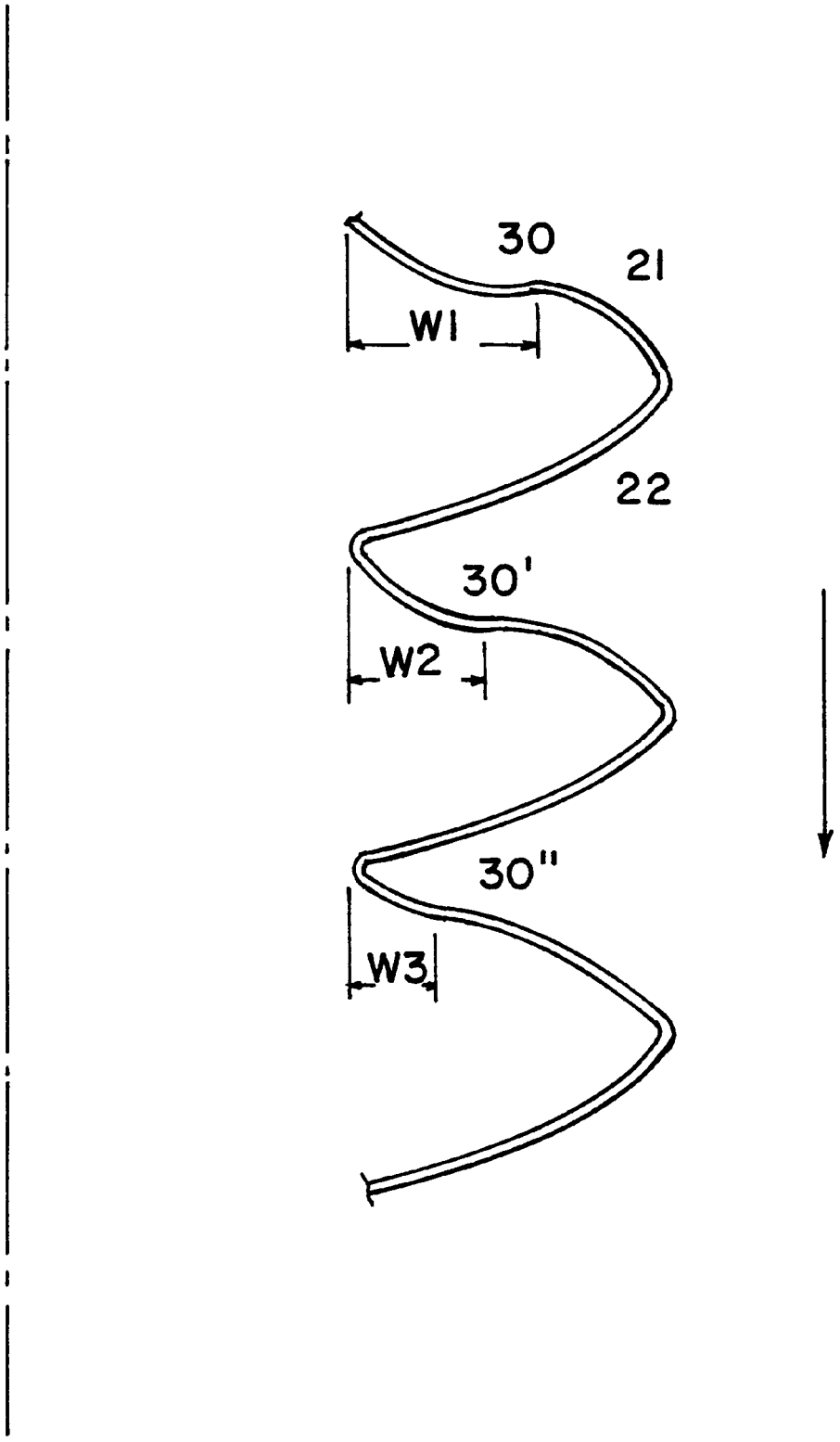
FIG. 12 is a vertical section view of a bellows ridge portion according to another embodiment of the invention.

FIG. 12 is a vertical section view of a bellows ridge portion according to another embodiment of the invention. FIG. 12 is similar to FIG. 11 except that the upper bellows wall 21 includes the concave deformation 30 and the lower bellows wall 22 is generally convex. The bellows walls may have varying thickness as described above with reference to FIG. 10. As shown in FIG. 12, an upper bellows ridge has a concave deformation 30 having a width W1. The adjacent bellows ridge has a concave deformation 30' having a width W2, where W2 is smaller than W1. The next bellows ridge has a concave deformation 30" having a width W3, where W3 is smaller than W2. By varying the width of the concave deformation 30, the contraction of the bellows ridges can be controlled to occur in an orderly, sequential fashion. As shown by the arrow in FIG. 12, the top bellows ridge having concave deformation 30 will collapse first, followed by the next bellows ridge having concave deformation 30' followed by the next bellows ridge having concave deformation 30".

The bellows ridges of a contractible plastic bellows container according to the present invention may be selectively and optionally provided with indentations described above. All bellows ridges need not have such indentations.

The bellows warping of a bellows container need not be only in a single direction. For example, the bellows ridges of the upper half of a bellows container can be warped upwards, and the bellows ridges of the lower half can be warped downwards. it is also possible to randomly provide indentations adjacent the outer hinges and lower hinges of the bellows ridges.

Utility of indentations according to the present invention can be largely the decision of the manufactures of bellows containers in accordance with the teaching of the present invention.

A bellows container according to the present invention may take various configurations as seen vertically, e.g., a cylinder, truncated cone, etc.

Accordingly, the claims appended hereto are meant to cover all modifications and changes within the spirit and scope of the present invention.

What is claimed is:

1. A contractible bellows container comprising:

a bellows ridge having an upper wall and a lower wall, said bellows ridge being positionable in an open state in which said upper wall and lower wall are spaced apart and in a contracted state in which said upper wall and lower wall are proximate;

said upper wall and said lower wall being coupled by an outer hinge;

said upper wall being coupled to a first adjacent bellows ridge by a first inner hinge;

said lower wall being coupled to a second adjacent bellows ridge by a second inner hinge;

wherein in said open state, one of said upper wall and said lower wall is generally s-shaped and includes a concave deformation and the other of said upper wall and said lower wall is generally convex.

2. The contractible bellows container of claim 1 wherein said concave deformation is adjacent to said outer hinge.

3. The contractible bellows container of claim 1 wherein said concave deformation is adjacent to one of said first inner hinge and said second inner hinge.

4. The contractible bellows container of claim 1 wherein said concave deformation is positioned on said upper wall and said concave deformation has a length ranging from ⅕ to ½ a length of said upper wall.

5. The contractible bellows container of claim 1 wherein said concave deformation is positioned on said lower wall and said concave deformation has a length ranging from ⅕ to ½ a length of said lower wall.

6. The contractible bellows container of claim 1 wherein:

the container has a centerline; and a thickness of one of said upper wall and said lower wall varies based on a distance from said centerline.

7. A contractible bellows container comprising:

a bellows ridge having an upper wall and a lower wall, said bellows ridge being positionable in an open state in which said upper wall and lower wall are spaced apart and in a contracted state in which said upper wall and lower wall are proximate;

said upper wall and said lower wall being coupled by an outer hinge;

said upper wall being coupled to a first adjacent bellows ridge by a first inner hinge;

said lower wall being coupled to a second adjacent bellows ridge by a second inner hinge;

wherein in said open state said upper wall is generally s-shaped and said lower wall is generally s-shaped.

8. The contractible bellows container of claim 7 wherein:

said upper wall includes a first concave deformation positioned adjacent said first inner hinge; and said lower wall includes a second concave deformation positioned adjacent said outer hinge.

9. The contractible bellows container of claim 7 wherein:

said upper wall includes a first concave deformation positioned adjacent said outer hinge; and said lower wall includes a second concave deformation positioned adjacent said second inner hinge.

10. The contractible bellows container of claim 7 wherein:

the container has a centerline; and a thickness of one of said upper wall and said lower wall varies based on a distance from said centerline.

11. A contractible bellows container comprising:

a first bellows ridge having a first upper wall and a first lower wall, said first bellows ridge being positionable in an open state in which said first upper wall and first lower wall are spaced apart and in a contracted state in which said first upper wall and first lower wall are proximate;

a first concave deformation positioned on one of said first upper wall and said first lower wall when said first bellows ridge is in said open state, said first concave deformation having a first width;

a second bellows ridge having a second upper wall and a second lower wall, said second bellows ridge being positionable in an open state in which said second upper wall and second lower wall are spaced apart and in a contracted state in which said second upper wall and second lower wall are proximate;

a second concave deformation positioned on one of said second upper wall and said second lower wall when said second bellows ridge is in said open state, said second concave deformation having a second width different than said first width.

12. The contractible bellows container of claim 11 wherein said first width is greater than said second width and said first bellows ridge contracts before said second bellows ridge.

13. The contractable bellows container of claim 12 wherein:

upon transition from said contracted state, said first bellows ridge enters said contracted state prior to said second bellows ridge.

14. The contractible bellows container of claim 11 wherein:

the container has a centerline; and a thickness of one of said first upper wall and said first lower wall varies based on a distance from said centerline.

15. The contractible bellows container of claim 11 wherein:

the container has a centerline; and a thickness of one of said second upper wall and said second lower wall varies based on a distance from said centerline.

* * * * *